US006024098A

United States Patent [19]

Neri et al.

[11] Patent Number: 6,024,098

[45] Date of Patent: Feb. 15, 2000

[54] METHOD OF DETECTING AND REJECTING POORLY FILLED CIGARETTES

[75] Inventors: Armando Neri, Bologna; Mario Turra, Casalecchio di Reno; Alessio Frontini, Bologna, all of Italy

[73] Assignee: G.D. Societa' Per Azioni, Bologna, Italy

[21] Appl. No.: 09/005,422

[22] Filed: Jan. 9, 1998

[30] Foreign Application Priority Data

Jan. 10, 1997 [IT] Italy ..... BO97A0010

[51] Int. Cl.[7] ..... A24C 5/32; B07C 5/00

[52] U.S. Cl. ..... 131/280; 131/907; 209/535; 209/643

[58] Field of Search ..... 131/280, 282, 131/283, 907, 908; 209/535, 536, 543, 643, 932; 53/54

[56] References Cited

U.S. PATENT DOCUMENTS 5,018,539 5/1991 Gamberini et al. ..... 131/280

FOREIGN PATENT DOCUMENTS 2228176 8/1990 United Kingdom .

*Primary Examiner*—Stanley S. Silverman
*Assistant Examiner*—Dionne A. Walls
*Attorney, Agent, or Firm*—Marshall, O'Toole, Gerstein, Murray & Borun

[57] ABSTRACT

A method of detecting and rejecting poorly filled cigarettes, whereby cigarettes, arranged along a gravity channel forming part of an outlet of a feedbox, are fed successively past a detecting device facing one end of the cigarettes; the detecting device, as the cigarettes file past, emits a continuous signal having a succession of minimum values indicating the passage past the detecting device of a succession of gaps, and a succession of maximum values indicating the passage past the detecting device of respective cigarettes; and a receiving central control unit emits a reject signal on receiving a maximum value below a given threshold value.

10 Claims, 3 Drawing Sheets

METHOD OF DETECTING AND REJECTING POORLY FILLED CIGARETTES

BACKGROUND OF THE INVENTION

The present invention relates to a method of detecting and rejecting poorly filled cigarettes.

The present invention may be used to advantage on a cigarette packing machine input unit—to which the following description refers purely by way of example—of the type wherein an input feedbox comprises an outlet, in turn comprising a reject device, and a number of side by side channels for feeding successive horizontal, superimposed, parallel layers of cigarettes to an extracting device, by which the layers are supplied to a device for forming groups of cigarettes; and wherein the reject device removes any faulty, i.e. at least poorly filled, cigarettes from each channel before the cigarettes are supplied to the group forming device.

On some known packing machines, the cigarettes are not checked until after the groups are formed, and any groups comprising even only one faulty cigarette are rejected.

To reduce the number of rejected cigarettes, and so provide for considerable saving, it has been proposed—in U.S. Pat. No. 4,592,470, for example—to check the cigarettes while still inside the feedbox, and reject any faulty cigarettes before the groups are formed.

The above method presents several drawbacks, mainly on account of the cigarettes being checked during the brief pause in the operation of the extracting device, and not always assuming the same position in front of the detecting device. That is, as the cigarettes must be checked and possibly rejected before reaching the extracting device, the detecting device must be located some distance from the extracting device, so that the two devices are necessarily separated by a column of cigarettes, the height of which varies as a function of humidity, any minor variations in the diameter of the cigarettes, and the traveling speed of the cigarettes (the faster the cigarettes in each column are traveling, the more they are compressed when arrested). As such, the cigarettes may not always be arrested in the same position in front of the detecting device, thus frequently resulting in scanning errors and the rejection of full or, even worse, the acceptance of poorly filled cigarettes.

SUMMARY OF THE INVENTION

It is an object of the present invention to provide a method of detecting and rejecting poorly filled cigarettes, designed to overcome the aforementioned drawbacks.

According to the present invention, there is provided a method of detecting and rejecting poorly filled cigarettes, the method comprising the stages of feeding a column of cigarettes transversely, substantially in steps, and in a given direction along a gravity channel forming part of an outlet of a feedbox, the channel extending past a detecting device, which is located at a fixed detecting station along the channel, and is positioned facing an open end of the cigarettes; scanning said open end of each cigarette to emit a signal indicating the degree to which the cigarette is filled; and using said signal, when necessary, to activate a reject device located along said channel, downstream from said detecting station in said direction; characterized in that said open end of each cigarette is scanned as the cigarette travels through said detecting station and in the course of one traveling step in said direction.

According to a preferred embodiment of the above method, the detecting device emits a continuous signal, which assumes a maximum value when the detecting station is totally occupied by a cigarette, and a minimum value when the detecting station is empty; said signal being modulated substantially sinusoidally as the cigarettes travel through the detecting station; and a receiving central control unit emitting a reject signal on receiving a maximum value below a given threshold value.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
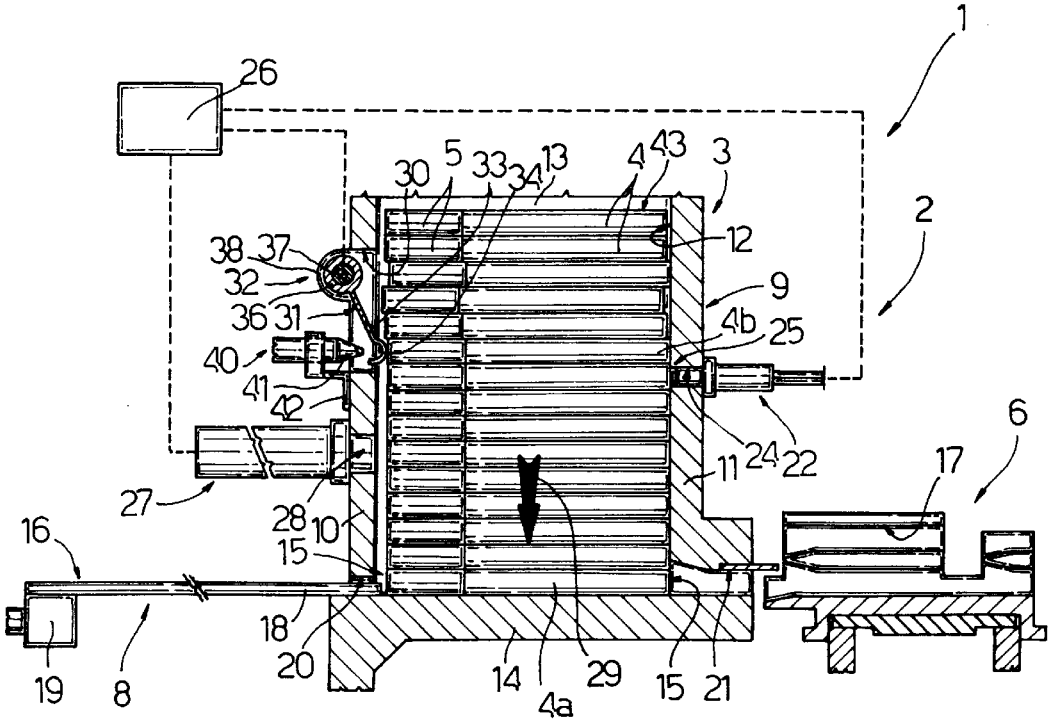
FIGS. 1 to 4 show sections, partly in block form and in four successive operating positions, of a preferred embodiment of a cigarette supply unit implementing the method according to the present invention.

Number 1 in FIG. 1 indicates a packing machine comprising an input unit 2, in turn comprising an input feedbox 3 for a mass (not shown) of cigarettes 4 arranged horizontally, and each having a filter 5. Unit 2 also comprises a device 6 for forming and conveying groups 7 (only one shown partially in FIGS. 1 to 4) of cigarettes 4, each group 7 comprising a number of cigarettes 4 equal to the content of a packet (not shown); and an extracting device 8 for feeding cigarettes 4 from feedbox 3 to device 6.

Feedbox 3 comprises at least one outlet 9 defined by a rear wall 10 facing filters 5, and by a vertical front wall 11 parallel to wall 10 and defining, with wall 10, a chamber of a width approximately equal to but no smaller than the length of cigarettes 4. The chamber is divided into a number of channels 12 (only one shown) by partitions or dividing walls 13 (only one shown in FIGS. 1 to 4) separated from one another by a distance approximately equal to but no smaller than the diameter of cigarettes 4.

Channels 12 are defined at the bottom by a horizontal plate 14 for supporting cigarettes 4, which are arranged in columns along respective channels 12 to define a number of superimposed horizontal layers 15. On contacting plate 14, each layer 15 is engaged by a pusher 16 forming part of extracting device 8, and is expelled, parallel to the longitudinal axis of cigarettes 4, from feedbox 3 into a respective pocket 17 of device 6.

Figure 2:
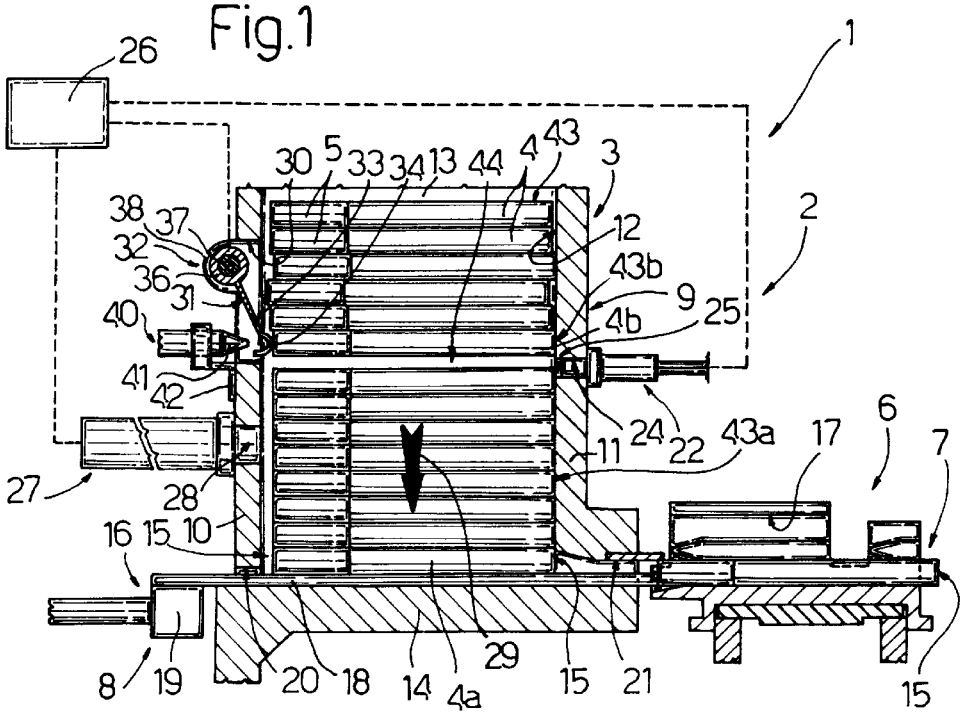
Figure 3:
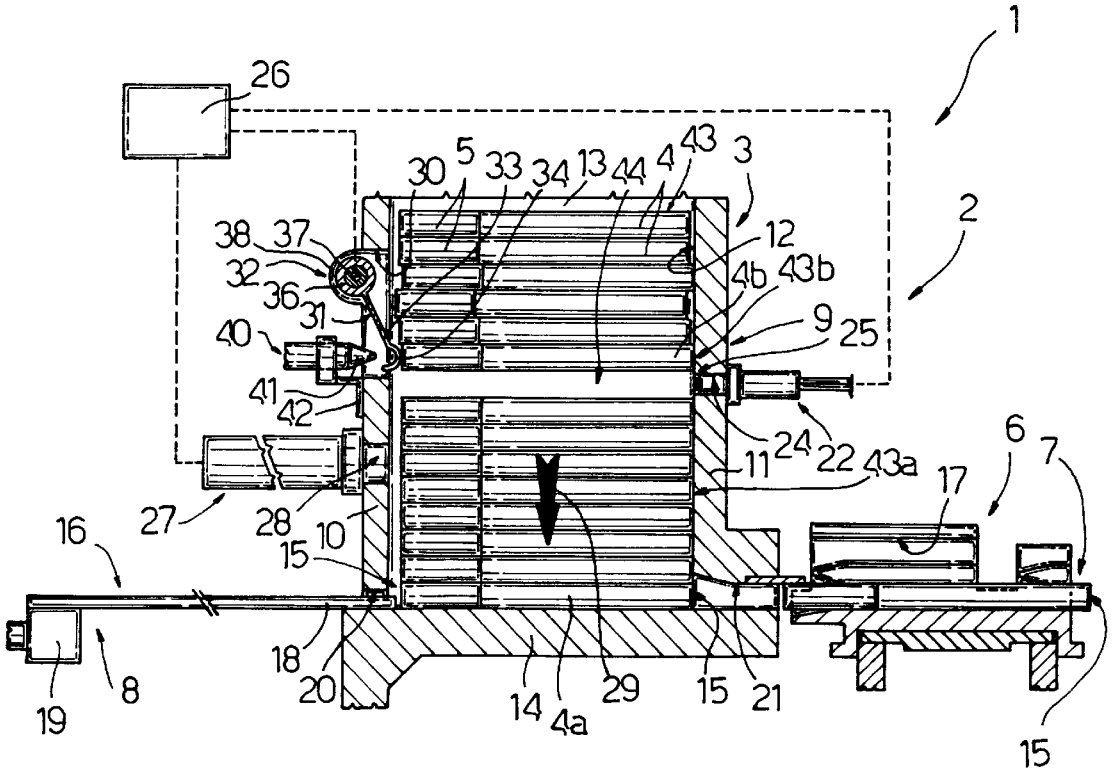
Figure 4:
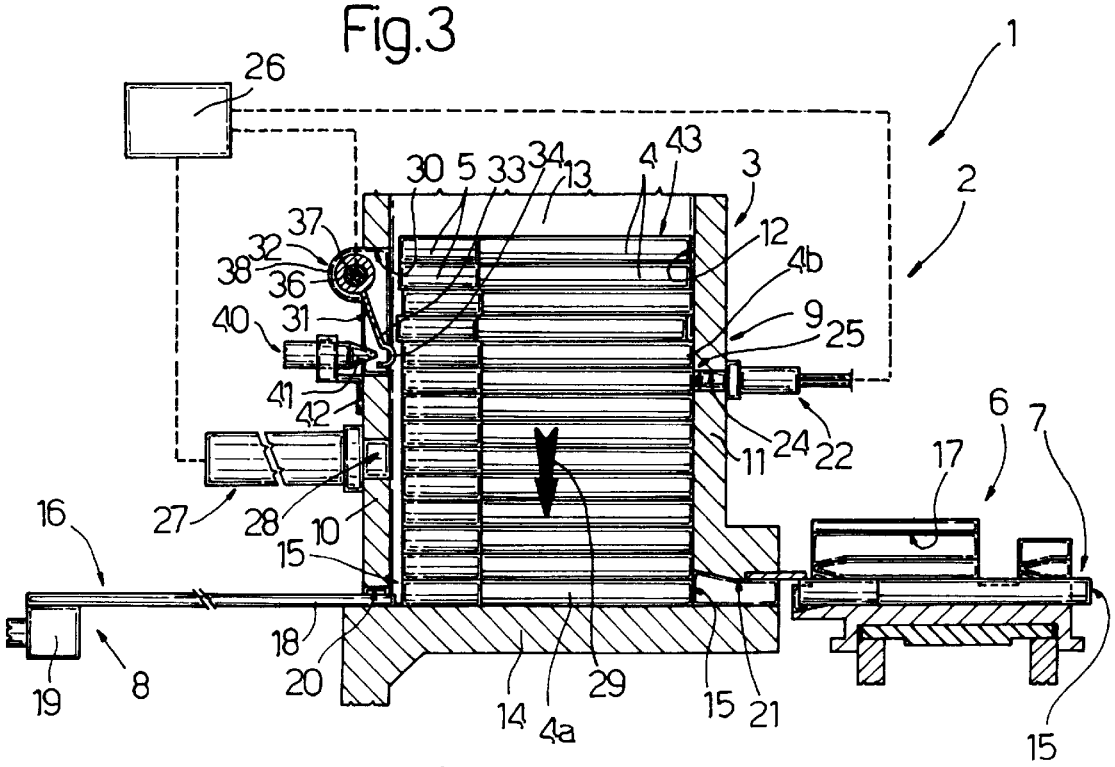

As shown in FIGS. 1 to 4, pusher 16 comprises a push element, in turn comprising a flat plate 18 mounted contacting the upper surface of plate 14, and which is slid along plate 14 by an actuating member 19 forming part of extracting device 8. Plate 18 is of a width approximately equal to but no smaller than the width of a layer 15, is of a thickness substantially equal to the radius of cigarettes 4, and is movable back and forth, through walls 10 and 11, between a forward operating position (FIG. 2) and a withdrawn idle position (FIGS. 1, 3 and 4). In the forward operating position, plate 18 engages two openings 20 and 21 through respective walls 10 and 11 to feed cigarettes 4 in layer 15 into a pocket 17. In the withdrawn idle position, plate 18 rests on plate 14 outside feedbox 3 and to the rear of rear wall 10 of feedbox 3.

Detailed descriptions of the structure of feedbox 3, extracting device 8 and device 6 are to be found in British Patents n. 1,298,785 and n. 2,023,994.

Figure 6:
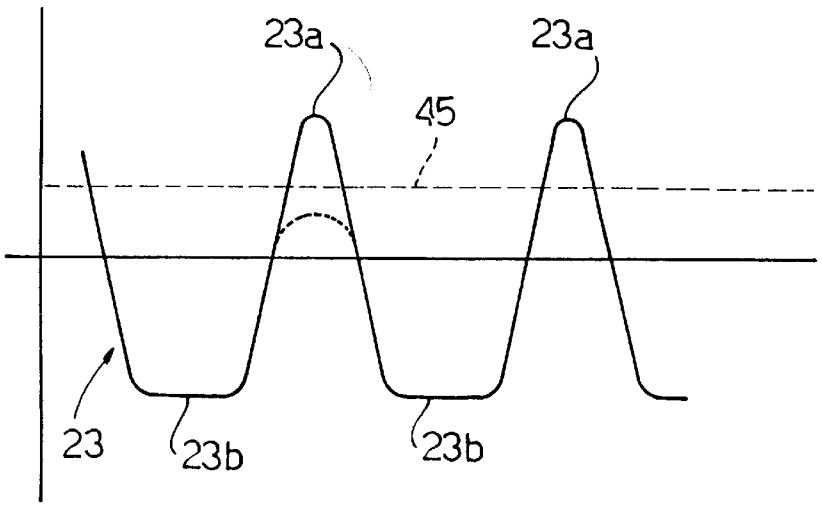
FIG. 6 shows a graph of a signal emitted by a detecting device forming a second detail in FIGS. 1 to 4.

Along each channel 12, to the front of wall 11, a known detecting device 22 is provided to check each cigarette 4 traveling along channel 12, by scanning said open end of each cigarette 4 and emitting a continuous signal 23 (FIG. 6), which is modulated by the cigarettes 4 traveling past device 22, and assumes maximum values indicating the degree to which the open ends of cigarettes 4 are filled. In the example shown, device 22 comprises a known optical device for determining the degree to which the open end of each cigarette 4 is filled, as the cigarette 4 travels past a hole 24 formed through wall 11 at a fixed detecting station 25.

The continuous signal 23 emitted by device 22 reaches a minimum 23b when the space inside channel 12 in front of hole 24 is empty, and a maximum 23*a* when the space inside channel 12 in front of hole 24 is fully occupied by a perfectly filled cigarette 4.

Signal 23 is received by a central control unit 26 (FIG. 1), which controls a known reject device 27 for pneumatically extracting any faulty cigarettes 4 from feedbox 3 through a hole formed in wall 10 of outlet 9 at a reject station 28 located downstream from detecting station 25 in the traveling direction 29 of cigarettes 4 towards plate 14.

At each channel 12, wall 10 comprises an opening 30 parallel to direction 29, immediately upstream from station 25 in direction 29, and which is engaged by a movable blade 31 of a stop device 32, which is activated to retain in position the cigarettes 4 located over station 25 in channel 12.

Figure 5:
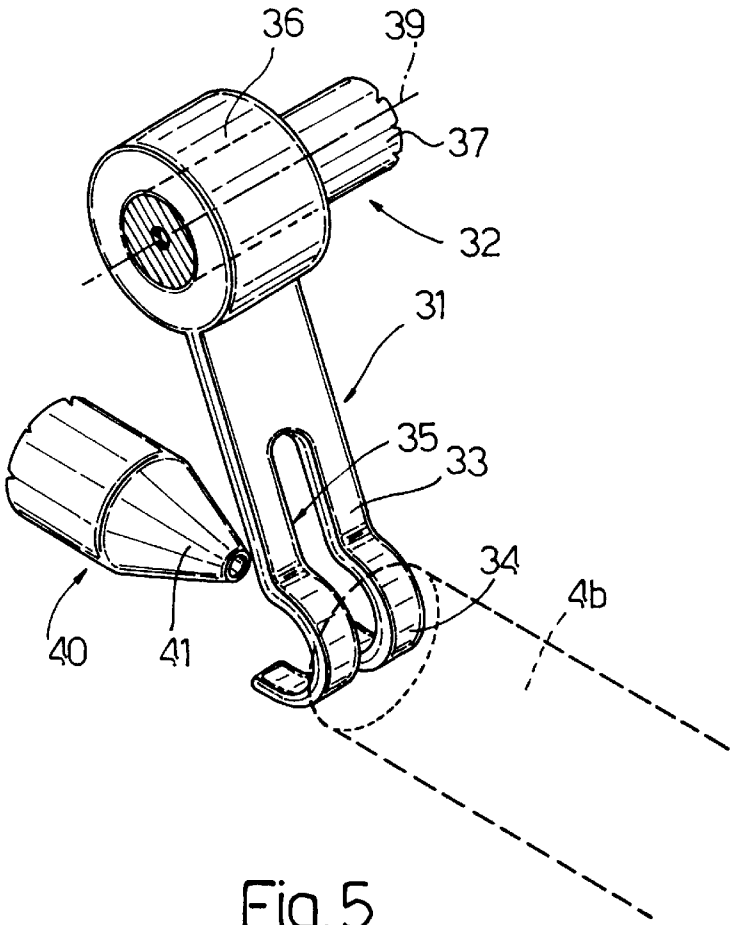
FIG. 5 shows a view in perspective of a first detail in FIGS. 1 to 4.

As shown more clearly in FIG. 5, a free end portion 33 of blade 31 is bent into a C to define a curved portion 34 facing inwards of respective channel 12 and comprising an axial through slot 35; and the end of blade 31 opposite portion 33 is connected integral with a hub 36 fitted to a powered shaft 37. Shaft 37 is fitted in rotary manner to a bracket 38 integral with wall 10, and oscillates about an axis 39, parallel to wall 10 and crosswise to opening 30, between an operating position (FIGS. 1, 2 and 3) in which curved portion 34 contacts any end point of filter 5 of cigarette 4 immediately above hole 24—hereinafter indicated 4*b*—to clamp the open end of cigarette 4*b* against wall 11, and an idle position (FIG. 4) in which curved portion 34 is located a given distance from filter 5 of the cigarette 4 facing it.

As shown in FIGS. 1 to 5, each stop device 32 is associated with a respective pneumatic aligning device 40 comprising a nozzle 41 fitted to wall 10 by a bracket 42, and for directing a jet of compressed air through respective opening 30 and slot 35 to ensure the open ends of cigarettes 4 are positioned contacting the inner surface of wall 11 at least at detecting station 25.

Operation of unit 2 will now be described as of the initial condition (FIG. 1) in which an empty pocket 17 of device 6 has been moved in a direction perpendicular to the FIG. 1 plane and arrested in front of outlet 9 and facing opening 21 in wall 11; and cigarettes 4 inside each channel 12 form a continuous column 43, i.e. a column in which cigarettes 4 in each pair of adjacent cigarettes 4 are positioned contacting each other, and the cigarette 4*a* at the bottom of column 43 contacts the upper surface of plate 14, with its open end facing opening 21 and its filter 5 facing opening 20.

Also in the above initial condition, plate 18 of pusher 16 is in the withdrawn position, in which only the end portion of plate 18 engages opening 20; blade 31 of stop device 32 is in the operating position with curved portion 34 contacting the end of filter 5 of a cigarette 4*b* immediately above hole 24; a cigarette 4 definitely occupies, at least partially, hole 24; and the continuous signal 23 emitted by device 22 is normally close to the maximum value 23*a*.

Finally, in the above initial condition, all the cigarettes 4*a* (only one shown) contacting plate 14 define a layer 15, which, at the next instant (FIG. 2), is fed into said pocket 17 by plate 18 moving from the withdrawn to the forward position. As the thickness of plate 18 is less than the diameter of cigarettes 4, some of the cigarettes inside each channel 12 drop down when cigarettes 4*a* are expelled from the bottom of respective columns 43. More specifically, as cigarette 4*b* in each column 43 is clamped in position by respective stop device 32, column 43 is divided into a top portion 43*b*, the bottom cigarette of which is defined by cigarette 4*b*; and a bottom portion 43*a*, in which the bottom cigarette 4*a* rests on plate 18, and the top cigarette 4 is separated from cigarette 4*b* by a gap 44 substantially facing respective hole 24 and of a height less than the diameter of cigarette 4.

At this operating stage, the continuous signal 23 emitted by device 22 is normally close to the minimum value 23*b*, due to the formation of gap 44 in front of device 22.

At the next operating stage (FIG. 3), plate 18 is restored to the withdrawn position, so that the bottom cigarettes 4*a* of portions 43*a* of respective columns 43 drop down on to plate 14 to form another layer of cigarettes 4*a*; cigarettes 4*b* remain clamped in position; and the gap 44 at hole 24 substantially doubles in height, so that signal 23 is definitely close to the minimum value 23*b*.

At the next operating stage (FIG. 4), blade 31 is moved into the idle position, so that each portion 43*b* drops down on to respective portion 43*a* to form another continuous column 43.

At this stage, or the next stage already described with reference to FIGS. 1 and 2, a cigarette 4 definitely travels past hole 24. That is, immediately following the formation of gap 44, an instant definitely exists in which a cigarette 4 traveling past device 22 fills hole 24 completely and is positioned coaxial with device 22, and in which signal 23 reaches the maximum value 23*a*, which increases according to the degree to which the free end of cigarette 4 is filled.

Upon the maximum value 23*a* falling below a given threshold value 45 indicating the minimum acceptable fill of the open end of cigarette 4, central control unit 26 emits a reject signal to activate reject device 27 as the cigarette 4 in question travels through reject station 28.

In connection with the above, it should be pointed out that, when cigarette 4*b* is released by blade 31 of stop device 32, and falls freely along channel 12 and through gap 44 past detecting device 22, thus enabling device 22 to determine the degree to which cigarette 4*b* is filled, cigarette 4*b* is maintained contacting the inner surface of wall 11 by aligning device 40 to prevent scanning errors, i.e. to prevent a cigarette 4 from being rejected, not because the open end is poorly filled, but because the open end, when scanned, is separated from device 22 by a distance greater than that for which device 22 is calibrated.

By checking cigarettes 4, not during the pause between one step and the next along respective channel 12, but as they travel through gap 44 formed at respective station 25, unit 2 therefore provides for determining the fill of the open ends of cigarettes 4 substantially regardless of both atmospheric humidity and the fall speed and diameters of cigarettes 4.

We claim:

1. A method of detecting and rejecting poorly filled cigarettes, the method comprising the stages of feeding a column of cigarettes transversely, substantially in steps, and in a given direction along a gravity channel forming part of an outlet of a feedbox, the channel extending past a detecting device, which is located at a fixed detecting station along the channel, and is positioned facing an open end of the cigarettes, scanning said open end of each cigarette to emit a signal indicating the degree to which the cigarette is filled; and using said signal, when necessary, to activate a reject device located along said channel, downstream from said detecting station in said direction; wherein said open end of each cigarette is scanned as the cigarette travels through said detecting station and in the course of one traveling step in said direction; the method further comprising the stages of cyclically arresting the travel of a top portion of said column, located upstream from said detecting station, to form a gap at the detecting station; and subsequently releasing said top portion of the column, so that a bottom cigarette in said top portion travels through said gap and, hence, through the detecting station; the open end of said bottom cigarette being scanned as said bottom cigarette drops through said gap.

2. A method as claimed in claim 1, wherein the detecting device emits a continuous signal, which assumes a maximum value when the detecting station is totally occupied by a cigarette, and a minimum value when the detecting station is empty; said signal being modulated substantially sinusoidally as the cigarettes travel through the detecting station; and a receiving central control unit emitting a reject signal on receiving a maximum value below a given threshold value.

3. A method as claimed in claim 1, wherein said arresting stage comprises the further substage of arresting the bottom cigarette in the top portion of the column by means of a stop device.

4. A method as claimed in claim 1, wherein said releasing stage commences when a bottom portion of the column, located downstream from the detecting station, has advanced at least one step.

5. A method as claimed in claim 1, comprising the further stage of maintaining the open end of the bottom cigarette at a given distance from the detecting device as the bottom cigarette is released and drops through the detecting station; said distance being measured along the axis of the bottom cigarette.

6. A method as claimed in claim 3, wherein the stop device comprises a lever having a curved portion for contacting the end of the bottom cigarette opposite the free end, and for gripping said bottom cigarette between said curved portion and a wall of said channel; said wall contacting the free end of the bottom cigarette.

7. A method as claimed in claim 5, wherein as the bottom cigarette is released and falls through the detecting station, pneumatic means exert thrust, by means of an air jet, on the end opposite the free end of the bottom cigarette to maintain the free end of the bottom cigarette in contact with a wall of the channel.

8. A method as claimed in claim 7, wherein the detecting device is fitted through said wall.

9. A method as claimed in claim 6, wherein said lever comprises a central slot; said air jet being directed through said slot.

10. A method as claimed in claim 1, wherein the bottom cigarette of the bottom portion of the column is expelled by a pusher of a thickness less than the diameter of a cigarette; said traveling step being performed in two successive jumps corresponding respectively to a forward and a return stoke of the pusher; and said traveling step being substantially equal to the diameter of a cigarette.

* * * * *